US010025267B2

(12) United States Patent
Boettcher et al.

(10) Patent No.: US 10,025,267 B2
(45) Date of Patent: Jul. 17, 2018

(54) CLEANER ASSEMBLY FOR REMOVING WASTE TONER IN AN ELECTROPHOTOGRAPHIC IMAGE FORMING DEVICE

(71) Applicant: LEXMARK INTERNATIONAL, INC., Lexington, KY (US)

(72) Inventors: Brian Lester Boettcher, Versailles, KY (US); Trey Dustin Gilliam, Lexington, KY (US); Christopher Strack, Lexington, KY (US); Ahren Michael Hoy, Charlotte, NC (US); Jose Paul Sacoto Aguilar, Florence, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/376,896

(22) Filed: Dec. 13, 2016

(65) Prior Publication Data

US 2017/0176926 A1 Jun. 22, 2017

Related U.S. Application Data

(60) Provisional application No. 62/268,113, filed on Dec. 16, 2015.

(51) Int. Cl.
*G03G 21/18* (2006.01)
*G03G 21/00* (2006.01)

(52) U.S. Cl.
CPC ..... *G03G 21/1814* (2013.01); *G03G 21/0011* (2013.01); *G03G 21/1828* (2013.01); *G03G 2221/1648* (2013.01)

(58) Field of Classification Search
CPC ..... G03G 21/1814; G03G 21/1828; G03G 21/0011; G03G 21/0017; G03G 2221/1648
See application file for complete search history.

(56) References Cited

U.S. PATENT DOCUMENTS 3,989,372 A * 11/1976 Davidge ..... G03G 21/0035 15/256.52
5,363,182 A 11/1994 Kuribayashi
(Continued)

FOREIGN PATENT DOCUMENTS

JP H01-188875 A 7/1989
JP H01-235986 A 9/1989
(Continued)

OTHER PUBLICATIONS

U.S. Appl. No. 15/376,908, filed Dec. 13, 2016 (Boettcher et al.).

*Primary Examiner* — Carla Therrien
(74) *Attorney, Agent, or Firm* — Justin M. Tromp

(57) ABSTRACT

A cleaner assembly for an electrophotographic image forming device according to one example embodiment includes a cleaner blade having a pair of longitudinal ends and a cleaning edge that extends between the pair of longitudinal ends for contacting a surface of a photoconductive drum to remove toner from the surface of the photoconductive drum. An end seal is positioned at one of the pair of longitudinal ends of the cleaner blade. The end seal includes a front side positioned to contact the surface of the photoconductive drum and a rear side opposite the front side. A tab extends from the end seal across the cleaning edge of the cleaner blade for preventing a longitudinal end section of the cleaning edge of the cleaner blade from contacting the surface of the photoconductive drum. The tab does not obstruct the front side of the end seal.

20 Claims, 14 Drawing Sheets

(56) References Cited

U.S. PATENT DOCUMENTS

| | | | | |
|---|---|---|---|---|
| 5,455,665 | A * | 10/1995 | Baba | G03G 21/0011 15/256.5 |
| 8,224,224 | B2 | 7/2012 | Ohmori et al. | |
| 8,886,080 | B2 | 11/2014 | Allen et al. | |
| 2003/0059227 | A1* | 3/2003 | Korfhage | G03G 21/0011 399/102 |
| 2004/0240915 | A1 | 12/2004 | Nakayama | |
| 2013/0287429 | A1* | 10/2013 | Allen | G03G 21/0029 399/102 |
| 2015/0338819 | A1 | 11/2015 | Ai | |

FOREIGN PATENT DOCUMENTS

| | | | |
|---|---|---|---|
| JP | H02-028687 | A | 1/1990 |
| JP | H02-106780 | A | 4/1990 |
| JP | H08-095454 | A | 4/1996 |
| JP | 2006-091566 | A | 4/2006 |

* cited by examiner

CLEANER ASSEMBLY FOR REMOVING WASTE TONER IN AN ELECTROPHOTOGRAPHIC IMAGE FORMING DEVICE

CROSS REFERENCES TO RELATED APPLICATIONS

This application claims priority to U.S. Provisional Patent Application Ser. No. 62/268,113, filed Dec. 16, 2015, entitled "Cleaner Assembly for Removing Waste Toner in an Electrophotographic Image Forming Device," the content of which is hereby incorporated by reference in its entirety.

BACKGROUND

1. Field of the Disclosure

The present disclosure relates generally to image forming devices and more particularly to a cleaner assembly for removing waste toner in an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the photoconductive drum. The toned image is transferred to the print media (e.g., paper) either directly by the photoconductive drum in a one-step transfer system or indirectly by an intermediate transfer member in a two-step transfer system. The toner is then fused to the media using heat and pressure to complete the print. Not all of the toner picked up by the photoconductive drum is transferred to the print media or intermediate transfer member due to inefficiencies in the image transfer process. Waste or residual toner left on the photoconductive drum after the photoconductive drum has contacted the print media or intermediate transfer member is removed before the next image is formed in order to avoid contamination of the next image. For this purpose, a cleaner blade in contact with the photoconductive drum (and, in a two-step transfer system, the intermediate transfer member) removes the waste toner from its surface. The waste toner is then moved to a waste toner reservoir where it is stored.

The cleaner blade may become damaged when operated under high friction. For example, the cleaner blade may flip out of position as a result of high friction between the cleaner blade and the surface of the photoconductive drum. High friction is frequently encountered at the longitudinal ends of the cleaner blade for several reasons. The cleaner blade is often wider (in the axial direction of the photoconductive drum) than an imaging region of the surface of the photoconductive drum. This allows for removal of all waste toner left on the photoconductive drum and allows for end seals to press on the back of the cleaner blade to ensure waste toner is properly contained within the waste toner reservoir. The end seals increase the force between the cleaner blade and the photoconductive drum thereby increasing the likelihood of cleaner blade flips, but are desired in order to prevent toner leaks at the axial ends of the photoconductive drum and cleaner blade. The amount of toner entering the cleaner blade-photoconductive drum nip at the axial ends of the cleaner blade is small due to the fact that the cleaner blade is wider than the imaging region of the photoconductive drum. There is some migration of toner to the axial ends of the cleaner blade, which helps lubricate the cleaner blade-photoconductive drum nip, but typically not enough to prevent cleaner blade flips. Accordingly, one approach to aid in preventing cleaner blade flips is the application of lubricant to the cleaner blade and/or photoconductive drum during manufacture. However, lubricants are often not reliable as they wear away over the course of operation.

Accordingly, a solution for preventing cleaner blade flips is desired.

SUMMARY

A replaceable unit for an electrophotographic image forming device according to one example embodiment includes a rotatable photoconductive drum having a rotational axis and a pair of axial ends. A cleaner blade extends longitudinally along the rotational axis of the photoconductive drum. The cleaner blade has a cleaning edge that contacts a surface of the photoconductive drum to remove toner from the surface of the photoconductive drum. A first end seal and a second end seal are each positioned at a respective axial end of the photoconductive drum. Each of the first and second end seals includes a front side and a rear side opposite the front side. At least a portion of the front side of each of the first and second end seals contacts the surface of the photoconductive drum. A first tab extends between the cleaner blade and the photoconductive drum preventing a first longitudinal end section of the cleaner blade from contacting the surface of the photoconductive drum. The first tab is anchored proximate the rear side of the first end seal or to an intermediate layer of the first end seal between the front and rear sides of the first end seal. The first tab is composed of a lower friction material than the portion of the front side of the first end seal that contacts the surface of the photoconductive drum. A second tab extends between the cleaner blade and the photoconductive drum preventing a second longitudinal end section of the cleaner blade from contacting the surface of the photoconductive drum. The second tab is anchored proximate the rear side of the second end seal or to an intermediate layer of the second end seal between the front and rear sides of the second end seal. The second tab is composed of a lower friction material than the portion of the front side of the second end seal that contacts the surface of the photoconductive drum.

A cleaner assembly for an electrophotographic image forming device according to one example embodiment includes a cleaner blade having a pair of longitudinal ends and a cleaning edge that extends between the pair of longitudinal ends for contacting a surface of a photoconductive drum to remove toner from the surface of the photoconductive drum. An end seal is positioned at one of the pair of longitudinal ends of the cleaner blade. The end seal includes a front side positioned to contact the surface of the photoconductive drum and a rear side opposite the front side. A tab extends from the end seal across the cleaning edge of the cleaner blade for preventing a longitudinal end section of the cleaning edge of the cleaner blade from contacting the surface of the photoconductive drum. The tab does not obstruct the front side of the end seal.

An end seal for sealing an end portion of a photoconductive drum in an electrophotographic image forming device according to one example embodiment includes a body having a front side contoured to contact a surface of a photoconductive drum and a rear side opposite the front side. A tab is attached to at least one of the rear side of the body and an intermediate layer of the body between the front and rear sides of the body. The tab extends from the body and is positioned to fit between the photoconductive drum and a cleaner blade to prevent a portion of the cleaner blade from contacting the surface of the photoconductive drum. The tab is composed of a lower friction material than the front side of the body.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
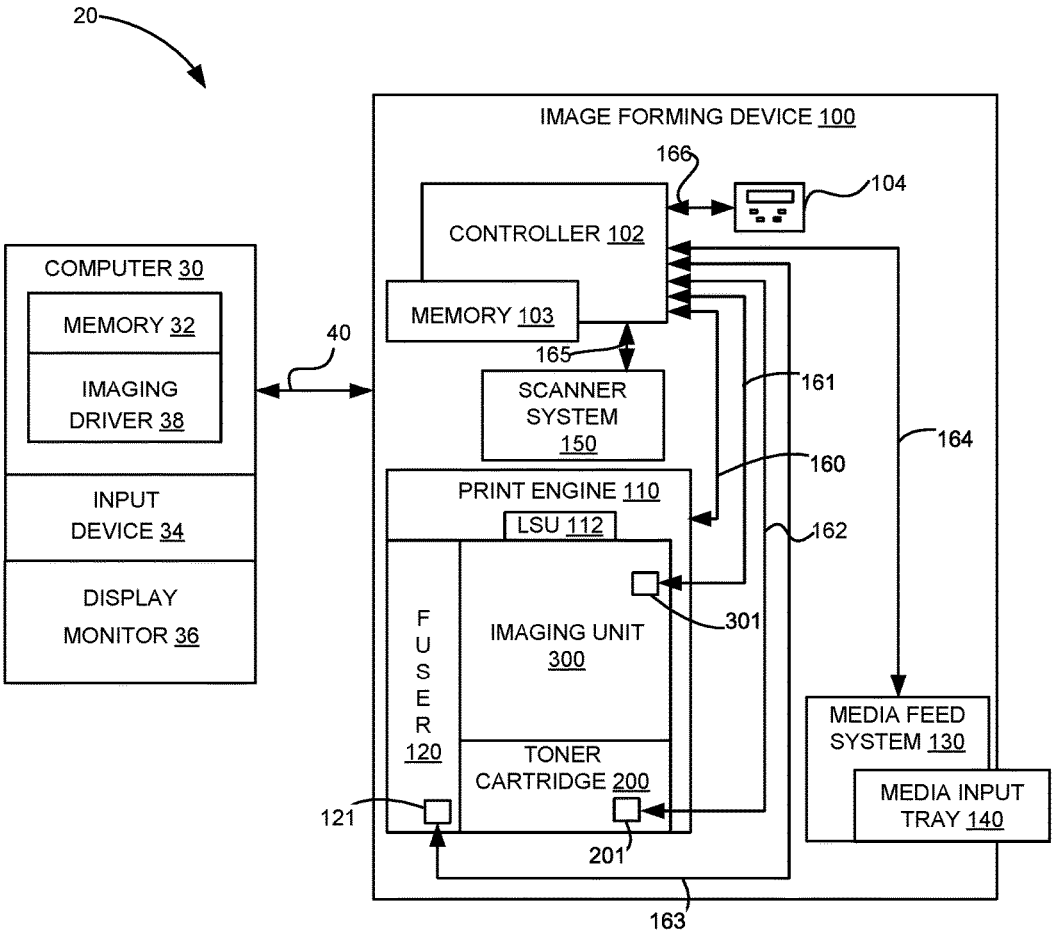
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
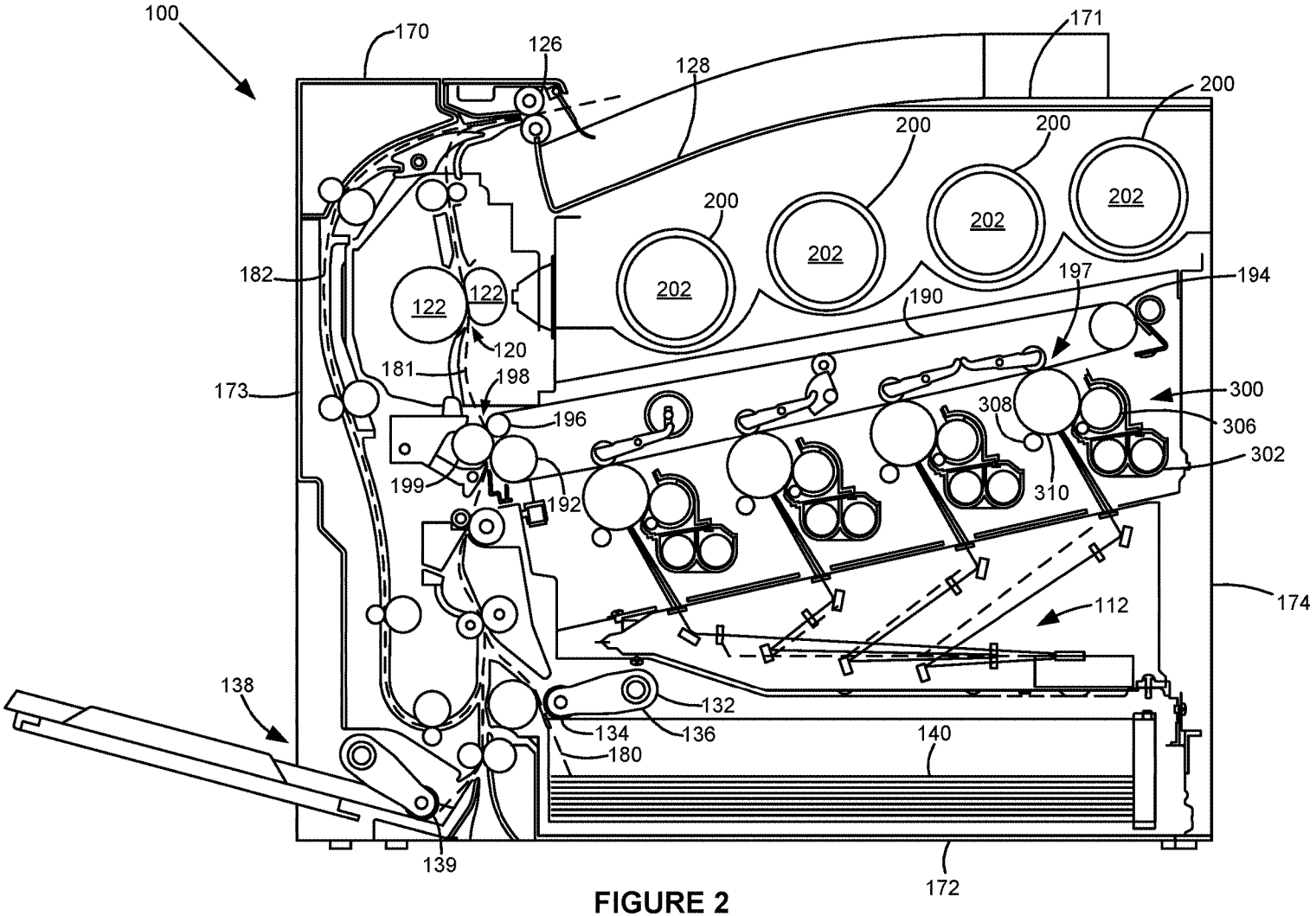
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173, rear 174 and a pair of sides (one facing out of the page and one facing into the page as viewed in FIG. 2). Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which are also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 contain yellow, cyan, magenta and black toner, respectively.

In the example embodiment illustrated, image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Magnetic roll 306 includes a stationary core that includes one or more permanent magnets and a rotatable sleeve that encircles the core. Reservoir 302 may include toner agitators, such as paddles, augers, etc., that stir the developer mix and present the developer mix to magnetic roll 306. Each imaging unit 300 also includes a charge roll 308, a photoconductive drum (PC drum) 310 and a cleaner blade (not shown) that collectively form a photoconductor unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. The permanent magnet(s) of magnetic roll 306 attract the carrier beads in reservoir 302 having toner thereon to the outer surface of the sleeve of magnetic roll 306. The sleeve of magnetic roll 306 transports the carrier beads having toner thereon past a trim bar that trims the mix of carrier beads and toner to a predetermined average height on the outer surface of the sleeve. The sleeve of magnetic roll 306 then transports the carrier heads having toner thereon to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a respective first transfer nip 197. In one embodiment, a positive voltage field attracts the toner images from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a multicolor image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art.

While the example image forming device 100 shown in FIG. 2 utilizes a dual component development system, in another embodiment, image forming device 100 utilizes what is commonly referred to as a single component development system. In this embodiment, a toner adder roll in each developer unit has an outer surface that is in contact with and forms a nip with the outer surface of a corresponding developer roll. As the toner adder roll and the developer roll rotate, the toner adder roll supplies toner in reservoir 302 to the developer roll. The developer roll is electrically charged and electrostatically attracts the toner particles supplied by the toner adder roll. A doctor blade positioned along each developer roll provides a substantially uniform layer of toner on the developer roll. The outer surface of the developer roll is also in contact with and forms a nip with the outer surface of a corresponding PC drum 310. As the developer roll and PC drum 310 rotate, toner particles are electrostatically transferred from the developer roll to the latent image on PC drum 310 forming a toned image on the surface of PC drum 310. PC drum 310 is charged by charge roll 308 and cleaned by a cleaner blade as discussed above.

Figure 3:
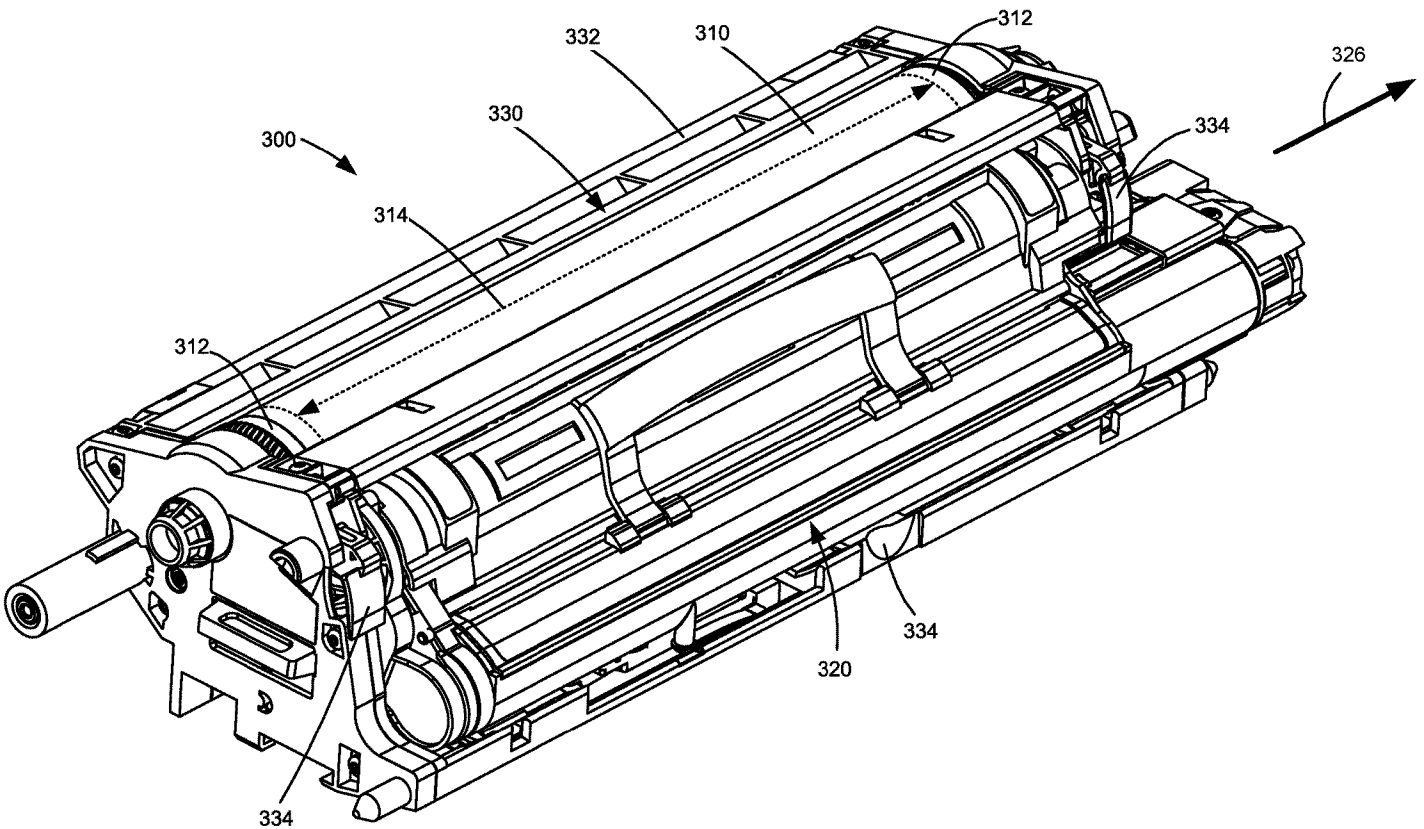
FIG. 3 is a perspective view of an imaging unit including a developer unit and a photoconductor unit according to one example embodiment.
Figure 4:
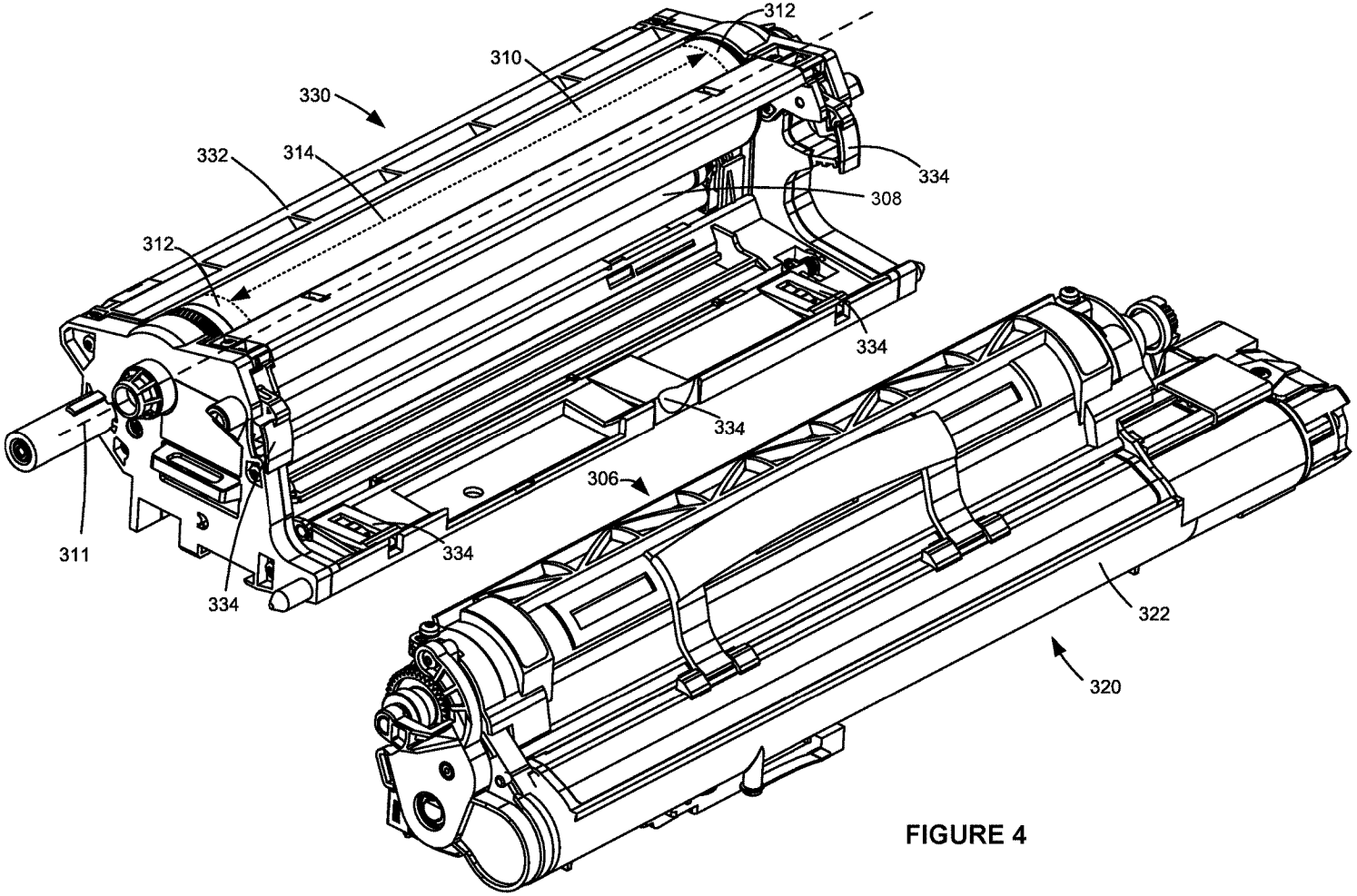
FIG. 4 is a perspective view of the imaging unit showing the developer unit separated from the photoconductor unit according to one example embodiment.

FIGS. 3 and 4 show imaging unit 300 according to one example embodiment. Imaging unit 300 includes a developer unit 320 and a photoconductor unit (PC unit) 330. In the example embodiment illustrated, developer unit 320 is removably coupled to PC unit 330 to permit repair or replacement of developer unit 320 independent of PC unit 330 and vice versa. In other embodiments, developer unit 320 and PC unit 330 are fixed together such that imaging unit 300 is replaced as a single unit. In the example embodiment illustrated, developer unit 320 and PC unit 330 are replaced independent of toner cartridge 200. In other embodiments, toner cartridge 200, developer unit 320 and PC unit 330 are replaced as a single unit. Additional configurations of toner cartridge 200, developer unit 320 and PC unit 330 may be used as desired. PC unit 330 includes a housing 332 having PC drum 310 as well as charge roll 308 and a cleaner blade mounted thereto. Housing 332 extends generally along a rotational axis 311 of PC drum 310. Housing 332 may also include one or more user-actuated latches 334 that couple developer unit 320 to PC unit 330 as shown in FIG. 3 for operation in image forming device 100 and that permit a user to separate developer unit 320 from PC unit 330 when imaging unit 300 is removed from image forming device 100 as shown in FIG. 4. Developer unit 320 includes a housing 322 having reservoir 302 therein. Housing 322 extends generally along a rotational axis of magnetic roll 306, which is substantially parallel to rotational axis 311 of PC drum 310. A portion of magnetic roll 306 is exposed from reservoir 302 at one side of housing 322 for mating with PC drum 310 when developer unit 320 is coupled to PC unit 330. When developer unit 320 is coupled to PC unit 330, imaging unit 300 is insertable into image forming device 100 via a sliding motion along an insertion direction 326 as indicated in FIG. 3.

Figure 5:
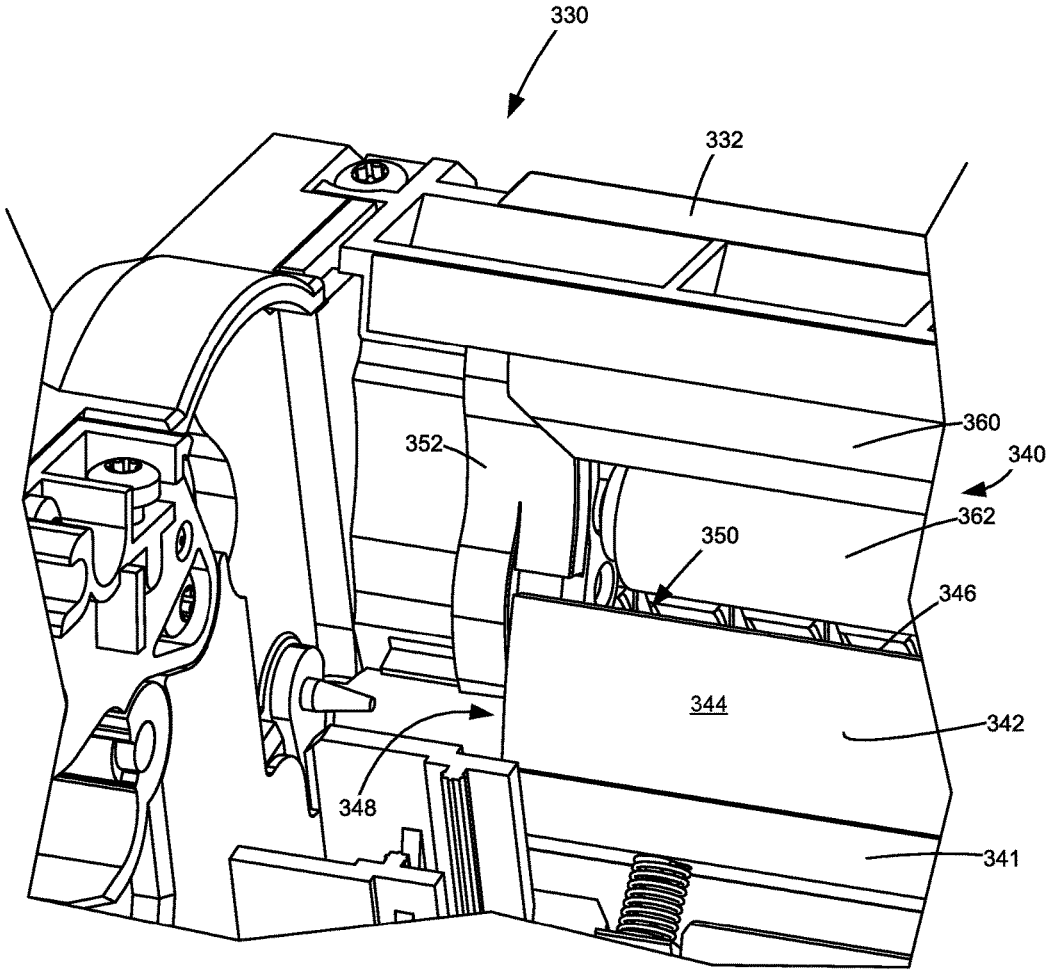
FIG. 5 is a perspective view of a portion of the photoconductor unit with a photoconductive drum and a charge roll omitted showing a cleaner assembly according to one example embodiment.

FIG. 5 shows a portion of PC unit 330 with PC drum 310 and charge roll 308 omitted to more clearly illustrate a cleaner assembly 340 according to one example embodiment. Cleaner assembly 340 includes a cleaner blade 342 positioned to remove toner remnants from the surface of PC drum 310 during operation so that the surface of PC drum 310 may be charged and developed with toner again to continue printing. Cleaner blade 342 extends along rotational axis 311 of PC drum 310. Cleaner blade 342 includes a front side 344 that faces PC drum 310 and a rear side 345 (FIG. 7) opposite front side 344. Cleaner blade 342 also includes a cleaning edge 346 that extends longitudinally between front side 344 and rear side 345. Cleaning edge 346 contacts and removes toner from the surface of PC drum 310. Toner removed from PC drum 310 by cleaner blade 342 falls into a waste toner sump 350 positioned behind cleaner blade 342 as viewed in FIG. 5 where the waste toner is moved, e.g., by an auger, to a larger waste toner reservoir. In the example embodiment illustrated, cleaner blade 342 is positioned on a bracket 341 that is mounted on housing 332 of PC unit 330.

An end seal 352 is positioned at each axial end of PC drum 310. End seals 352 contact the outer surface of PC drum 310 at the axial ends 312 (FIGS. 3 and 4) of PC drum 310, beyond a central imaging region 314 (FIGS. 3 and 4) of PC drum 310 that receives toner from magnetic roll 306, in order to prevent toner on PC drum 310 from migrating along the surface of PC drum 310 to the axial ends 312 of PC drum 310. End seals 352 also abut axial ends 312 of PC drum 310 and longitudinal ends 348 of cleaner blade 342 in order to prevent toner from leaking beyond axial ends 312 of PC drum 310 and longitudinal ends 348 of cleaner blade 342. In the example embodiment illustrated, a rear side 354 (FIG. 11) of end seal 352 is adhered to a portion of housing 332 of PC unit 330.

An entry seal 360 is positioned upstream from cleaner blade 342 relative to an operative rotational direction 316 (FIG. 9) of PC drum 310 in order to provide additional sealing of waste toner sump 350. A lubricant brush 362 may extend longitudinally along the length of PC drum 310 and be positioned between entry seal 360 and cleaner blade 342 to apply a lubricant, e.g., zinc stearate, to the surface of PC drum 310 during operation.

Figure 6:
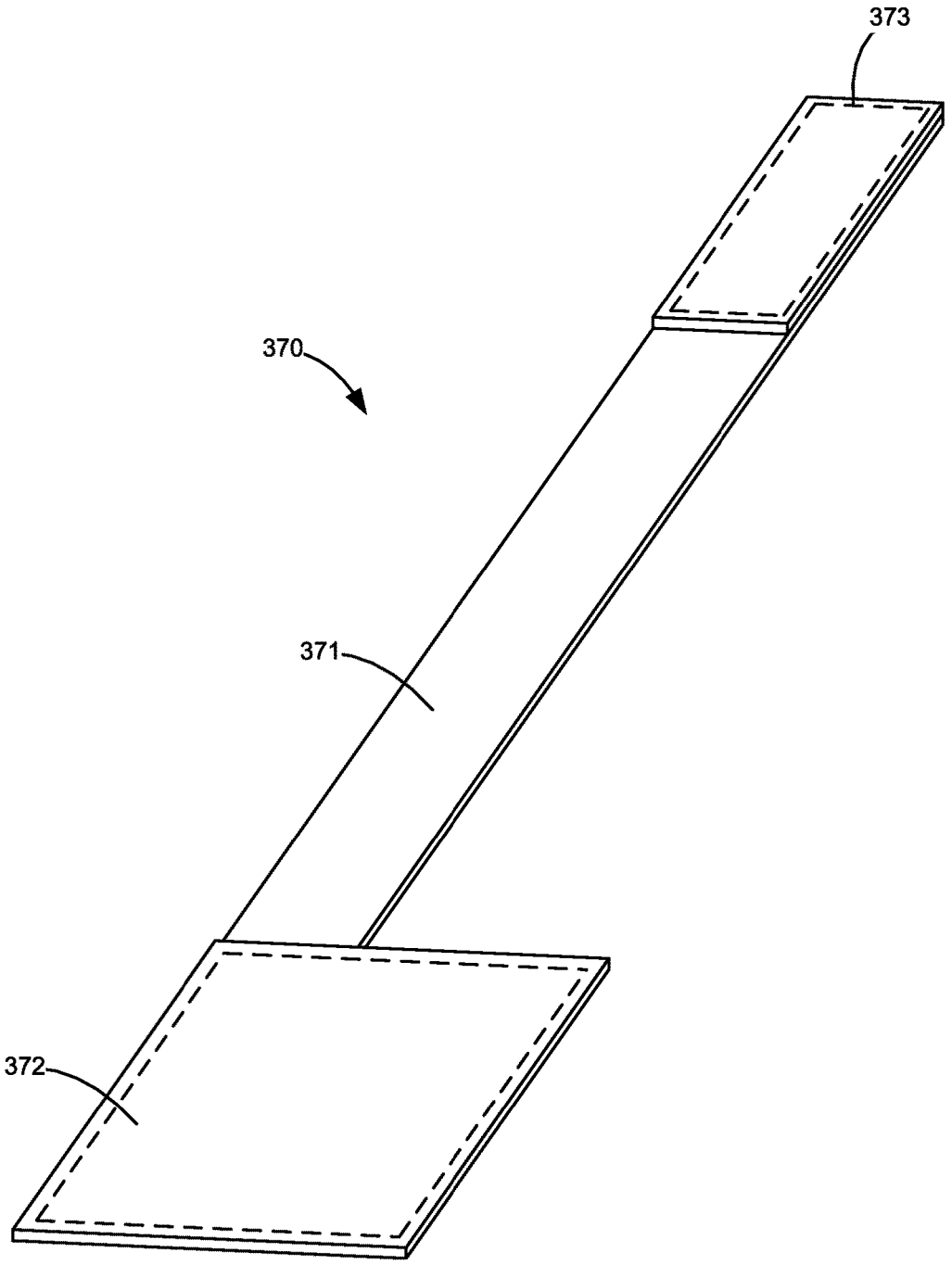
FIG. 6 is a perspective view of a low friction strip according to one example embodiment for use with the cleaner assembly.
Figure 7:
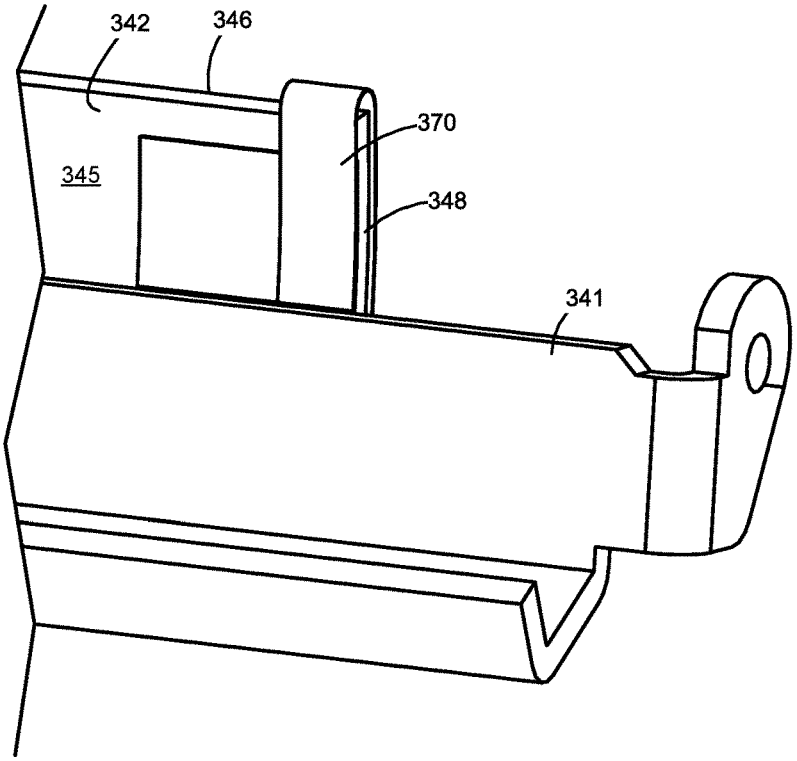
FIGS. 7 and 8 are a rear perspective view and a front perspective view, respectively, of a cleaner blade of the cleaner assembly showing the low friction strip shown in FIG. 6 attached to a longitudinal end of the cleaner blade according to one example embodiment.
Figure 8:
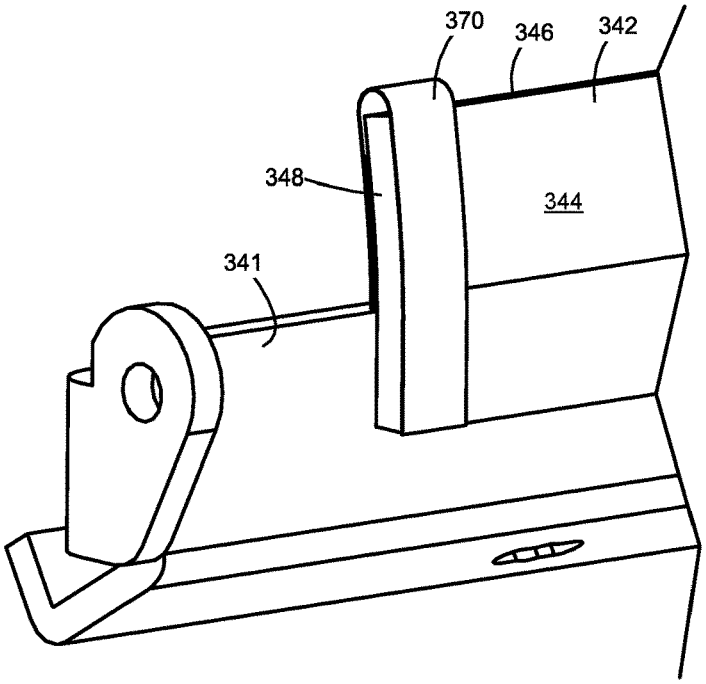

FIGS. 6-10 show a first example embodiment of cleaner assembly 340 that includes a low friction strip 370 positioned on cleaner blade 342 at each longitudinal end 348 of cleaner blade 342 to prevent each longitudinal end section of cleaner blade 342 from contacting PC drum 310. FIG. 6 shows strip 370 prior to positioning on cleaner blade 342 according to one example. Strip 370 may be composed of any relatively firm, low friction material, such as Mylar. Strip 370 is composed of a lower friction material than cleaner blade 342. In the embodiment illustrated, on one side 371, strip 370 includes an adhesive section 372, 373 at each end of strip 370. FIGS. 7 and 8 show strip 370 adhered to rear side 345 and front side 344 of cleaner blade 342, respectively, with strip 370 wrapped over cleaning edge 346 of cleaner blade 342. Adhesive section 372 of strip 370 that adheres to rear side 345 of cleaner blade 342 retains strip 370 in its proper position on cleaner blade 342 and prevents strip 370 from being pulled through a cleaner blade-PC drum nip 364 (FIG. 9) as PC drum 310 rotates. Adhesive section 373 of strip 370 that adheres to front side 344 of cleaner blade 342 serves as an assembly aid. Otherwise, it may be difficult to ensure that strip 370 is properly captured between cleaner blade 342 and PC drum 310 during assembly. In the example embodiment illustrated, adhesive section 372 is larger in area accommodating more adhesive than adhesive section 373. In other embodiments, strip 370 is adhered only to rear side 345 of cleaner blade 342 and wraps over cleaning edge 346 and is folded against front side 344 of cleaner blade 342. While the example embodiment illustrated shows strip 370 adhered to cleaner blade 342, it will be appreciated that strip 370 may be attached to cleaner blade 342 by any suitable method. Further, in other embodiments, strip 370 is anchored (e.g., by an adhesive) behind cleaner blade 342, such as to a portion of housing 332 or to bracket 341, instead of to cleaner blade 342, and wrapped over cleaning edge 346 and folded against front side 344 of cleaner blade 342.

Figure 9:
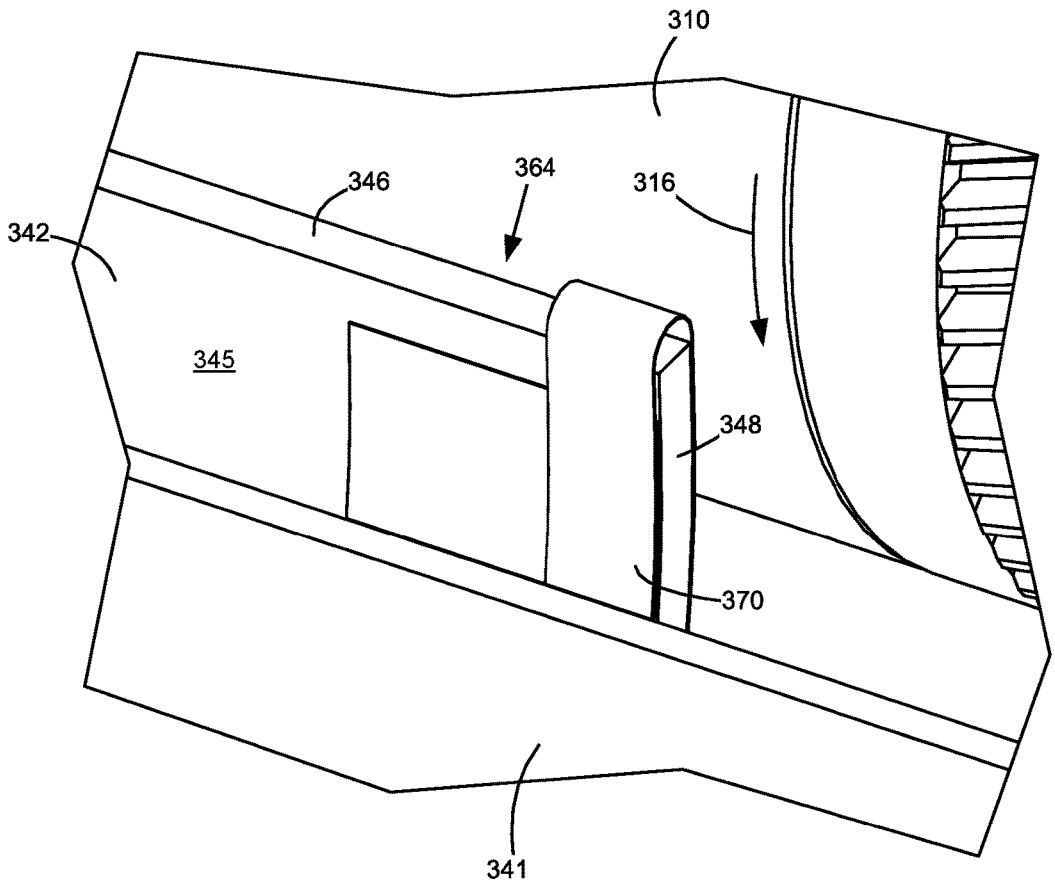
FIG. 9 is a rear perspective view of the cleaner assembly showing the low friction strip shown in FIGS. 6-8 separating a longitudinal end section of the cleaner blade from the surface of the photoconductive drum according to one example embodiment.
Figure 10:
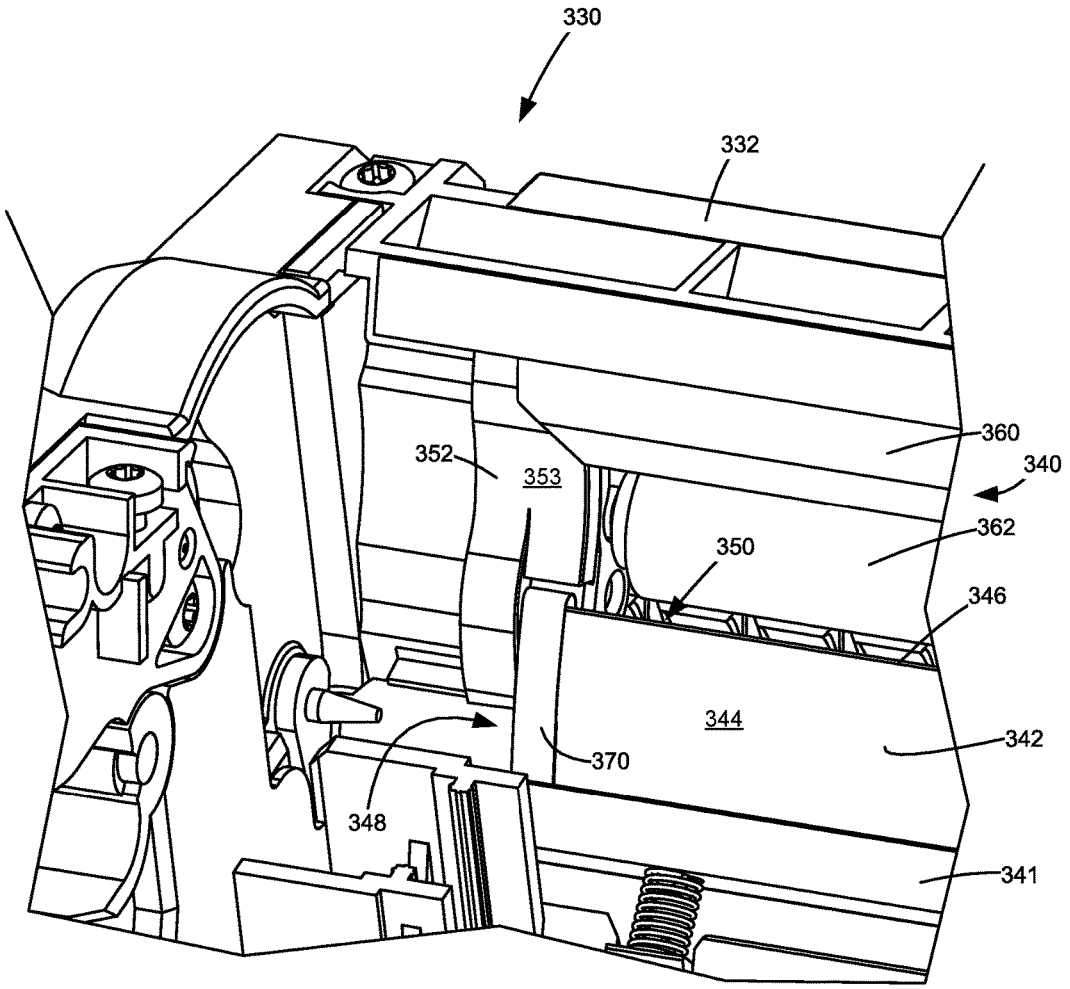
FIG. 10 is a perspective view of a portion of the photoconductor unit with the photoconductive drum and the charge roll omitted showing the cleaner assembly having the low friction strip shown in FIGS. 6-9 attached to the cleaner blade according to one example embodiment.

A respective strip 370 is positioned at each longitudinal end 348 of cleaner blade 342 such that the strip 370 covers a portion of rear side 345, front side 344 and cleaning edge 346 of cleaner blade 342 at the longitudinal end 348 of cleaner blade 342. FIG. 9 shows cleaner blade 342 positioned against PC drum 310 during operation. The operative rotational direction 316 of PC drum 310 is indicated by the arrow in FIG. 9. Strip 370 forms a low friction barrier between cleaner blade 342 and PC drum 310 (between front side 344 and cleaning edge 346 of cleaner blade 342 and PC drum 310) at the longitudinal end 348 of cleaner blade 342. In one embodiment, strip 370 covers about 4 mm of the surface of cleaner blade 342 along the longitudinal direction of cleaner blade 342 (along the width of strip 370 and the axial direction of PC drum 310) at the longitudinal end 348 of cleaner blade 342. However, the width of strip 370 may be greater or less depending on the relative lengths of cleaner blade 342, PC drum 310 and imaging region 314 of PC drum 310 along the axial direction of PC drum 310. The relatively low friction material of strip 370 reduces the otherwise high frictional force applied to cleaner blade 342 at the longitudinal ends 348 of cleaner blade 342 that can lead to cleaner blade 342 flips. FIG. 10 shows strip 370 positioned at the longitudinal end 348 of cleaner blade 342 with PC drum 310 and charge roll 308 omitted for clarity. As shown in FIG. 10, in the embodiment illustrated, strip 370 does not obstruct a front side 353 of end seal 352 upstream from (relative to operative rotational direction 316 of PC drum 310) cleaning edge 346 of cleaner blade 342 such that strip 370 does not compromise the sealing of PC drum 310 provided by end seal 352. That is, front side 353 of end seal 352 is not blocked by strip 370 from contacting the surface of PC drum 310 upstream from cleaning edge 346 of cleaner blade 342.

Figure 11:
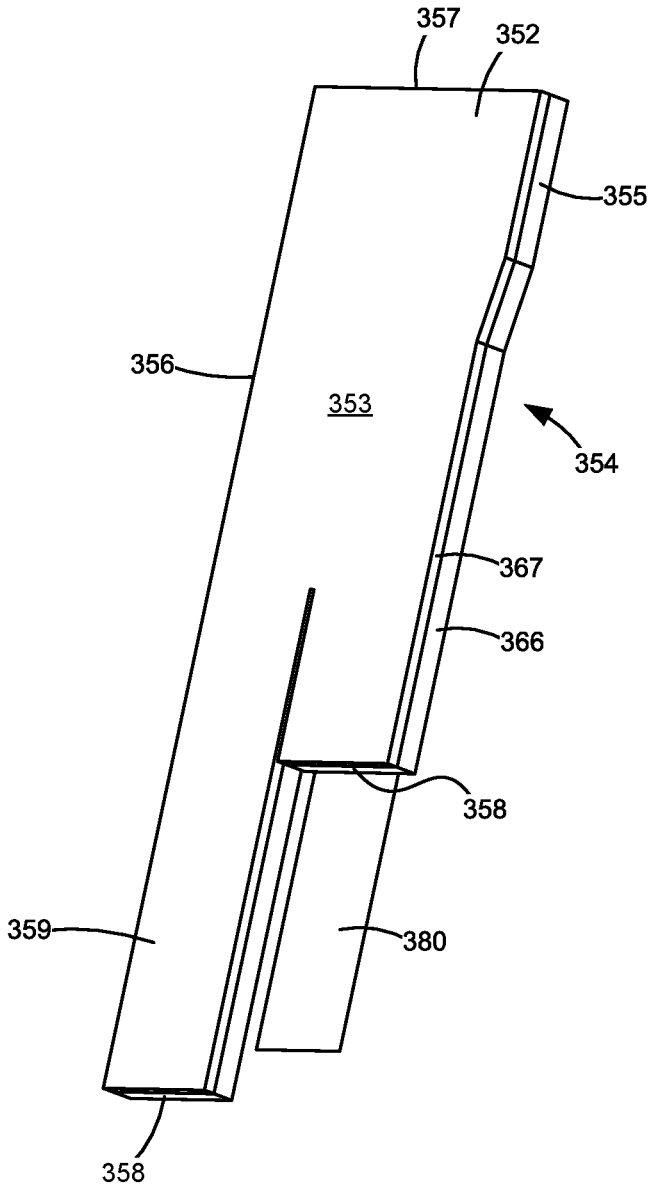
FIG. 11 is a perspective view of an end seal having a low friction tab positioned thereon according to one example embodiment for use with the cleaner assembly.

FIGS. 11-14 show a second example embodiment of cleaner assembly 340 that includes a low friction tab 380 on end seal 352 to prevent a longitudinal end section of cleaner blade 342 from contacting PC drum 310. FIG. 11 shows an end seal 352 having low friction tab 380 positioned thereon according to one example. End seal 352 includes a front side 353 that faces toward PC drum 310 and a rear side 354 opposite front side 353 as well as an inboard side 355 that is axially inboard relative to PC drum 310 and an outboard side 356 that is axially outboard relative to PC drum 310. End seal 352 also includes a top or upstream end 357 and a bottom or downstream end 358. Upstream end 357 is positioned upstream from downstream end 358 relative to the operative rotational direction 316 of PC drum 310. Upstream end 357 of end seal 352 is positioned proximate to entry seal 360 and downstream end 358 of entry seal 352 is positioned proximate to cleaner blade 342. The outboard side 356 of downstream end 358 of end seal 352 includes an outer leg 359 that extends further in the operative rotational direction 316 of PC drum 310 than the inboard side 355 of downstream end 358 of end seal 352. When cleaner assembly 340 is installed, the inboard side 355 of outer leg 359 abuts the axial end 312 of PC drum 310 and the longitudinal end 348 of cleaner blade 342 to prevent toner from leaking past the axial end 312 of PC drum 310 and the longitudinal end 348 of cleaner blade 342. The portion of the front side 353 of end seal 352 proximate the inboard side 355 of end seal 352 contacts the outer surface of PC drum 310 to prevent toner on PC drum 310 from migrating along the surface of PC drum 310 to the axial end 312 of PC drum 310. In the embodiment illustrated, end seal 352 includes a foam backing 366 with a lower friction (relative to foam backing 366) felt or suede material 367 adhered on the front side of foam backing 366. In some embodiments, the foam backing 366 and the felt/suede material 367 are laminated together as a unitary piece. However, end seal 352 may have any suitable construction and may be formed of other suitable materials.

Figure 15:
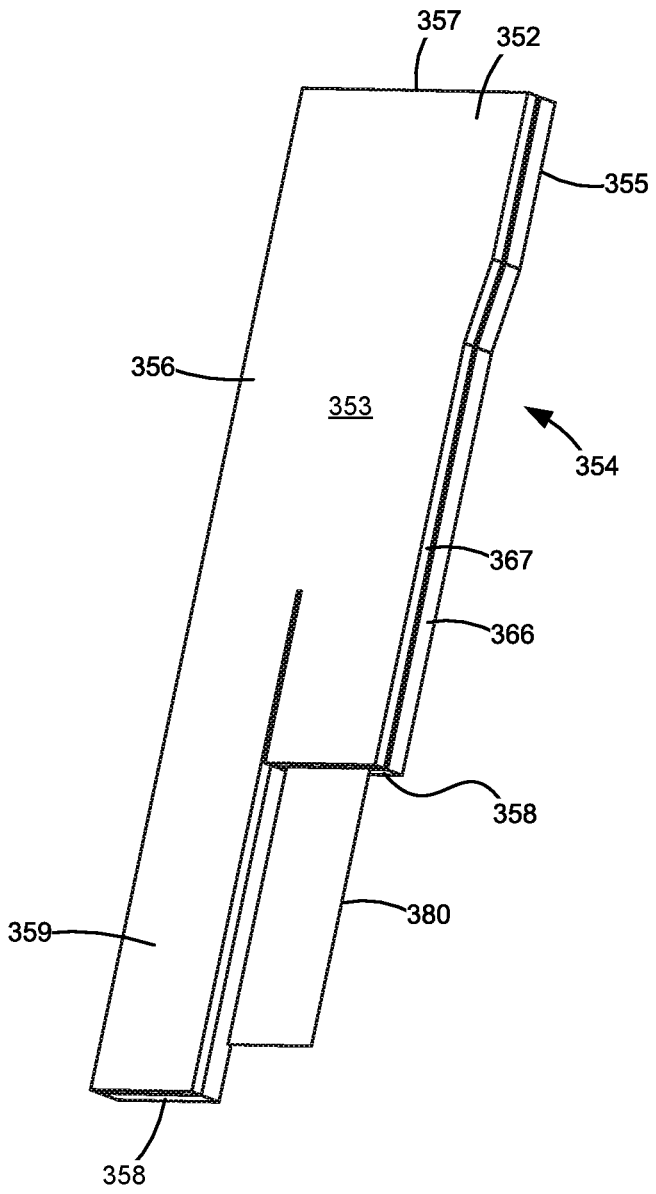
FIG. 15 is a perspective view of an end seal having a low friction tab positioned thereon according to another example embodiment for use with the cleaner assembly.

In the embodiment illustrated, a low friction tab 380 is attached to each end seal 352 and extends in a cantilevered manner from the downstream end 358 of the inboard side 355 of end seal 352 as shown in FIG. 11. As discussed above, tab 380 may be composed of any relatively firm, low friction material, such as Mylar. Tab 380 is composed of a lower friction material than cleaner blade 342 and the material on front side 353 of end seal 352, such as suede material 367. Tab 380 may be attached to end seal 352, for example, by an adhesive or laminated to end seal 352 forming a unitary piece. In the example embodiment illustrated, tab 380 is attached to rear side 354 of end seal 352, behind foam backing 366. In another embodiment, tab 380 is anchored to a portion of housing 332 behind end seal 352. In another embodiment, tab 380 is positioned on an intermediate layer of end seal 352, between front side 353 and rear side 354, such as a layer between foam backing 366 and the felt/suede material 367 (FIG. 15).

Figure 12:
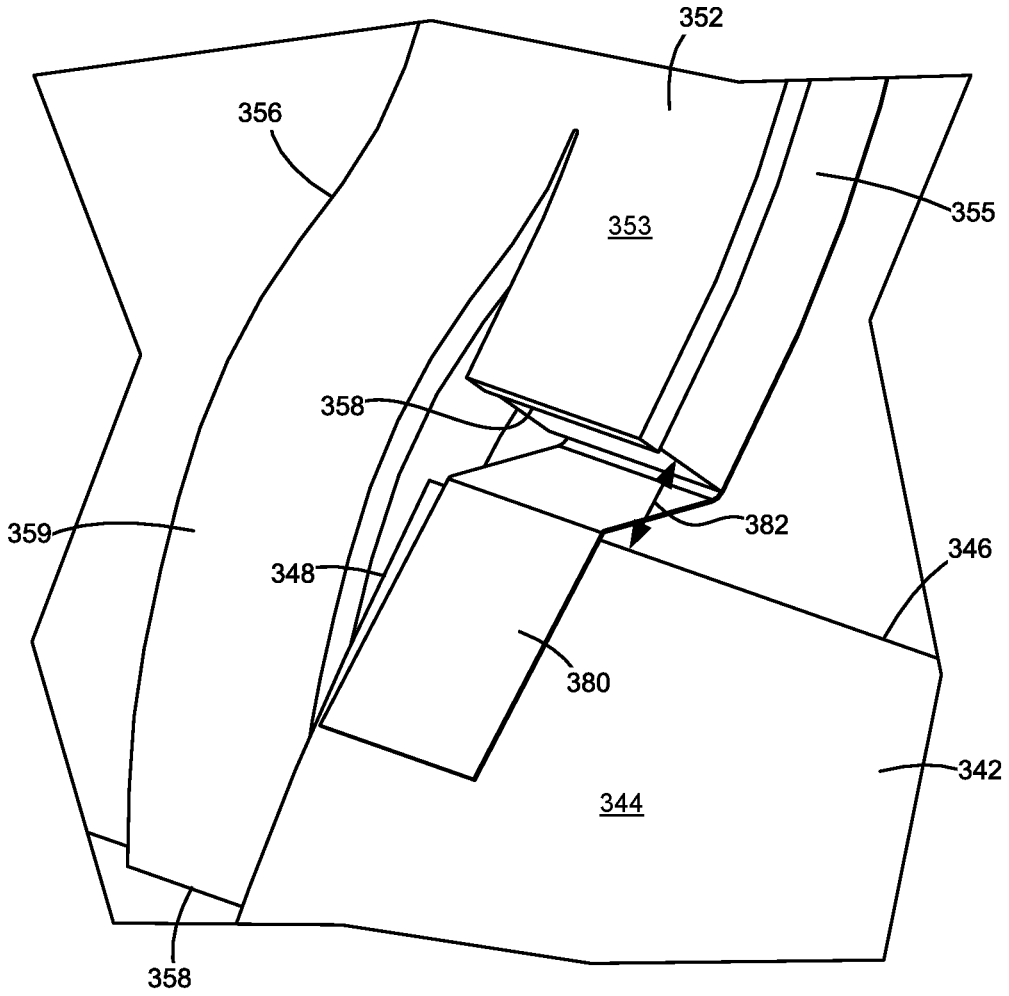
FIG. 12 is a front perspective view of the end seal shown in FIG. 11 positioned relative to the cleaner blade according to one example embodiment.

FIG. 12 shows end seal 352 and cleaner blade 342 installed relative to each other. The portion of tab 380 extending from downstream end 358 of end seal 352 is positioned on front side 344 of cleaner blade 342 such that tab 380 covers front side 344 and cleaning edge 346 of cleaner blade 342 at the longitudinal end 348 of cleaner blade 342 as shown in FIG. 12. In some embodiments, tab 380 is not adhered to cleaner blade 342 and is merely laid along front side 344 of cleaner blade 342. In these embodiments, the rotation of PC drum 310 in its operative rotational direction 316 retains tab 380 against front side 344 of cleaner blade 342. In some embodiments, PC drum 310 is periodically rotated counter to its operative rotational direction 316 slightly, e.g., to introduce slack to a gear train driving PC drum 310 in order to aid in removal of photoconductor unit 330 from image forming device 100. In those embodiments where PC drum 310 is periodically rotated counter to its operative rotational direction 316, it is preferred that tab 380 is long enough so that, tab 380 isn't pulled past cleaning edge 346 of cleaner blade 342 when PC drum 310 is rotated counter to its operative rotational direction 316.

As shown in FIG. 12, a gap 382 is formed between the downstream end 358 of the inboard side 355 of end seal 352 and cleaning edge 346 of cleaner blade 342. In this embodiment, tab 380 is pulled taught between the cleaner blade-PC drum nip 364 and the adhesion between rear side 354 of end seal 352 and housing 332 of PC unit 330. The tension in tab 380 results in extra compression of end seal 352 against the surface of PC drum 310 towards the downstream end 358 of the inboard side 355 of end seal 352. If the gap 382 between the downstream end 358 of the inboard side 355 of end seal 352 and cleaning edge 346 of cleaner blade 342 is too small, end seal 352 could be pulled into the cleaner blade-PC drum nip 364 where the rotation of PC drum 310 could delaminate and destroy end seal 352. On the other hand, if gap 382 between the downstream end 358 of the inboard side 355 of end seal 352 and cleaning edge 346 of cleaner blade 342 is too large, the sealing function of end seal 352 could be compromised. Accordingly, gap 382 is preferably large enough to allow compression of end seal 352 without end seal 352 entering the cleaner blade-PC drum nip 364 but small enough to provide the desired toner sealing.

Figure 13:
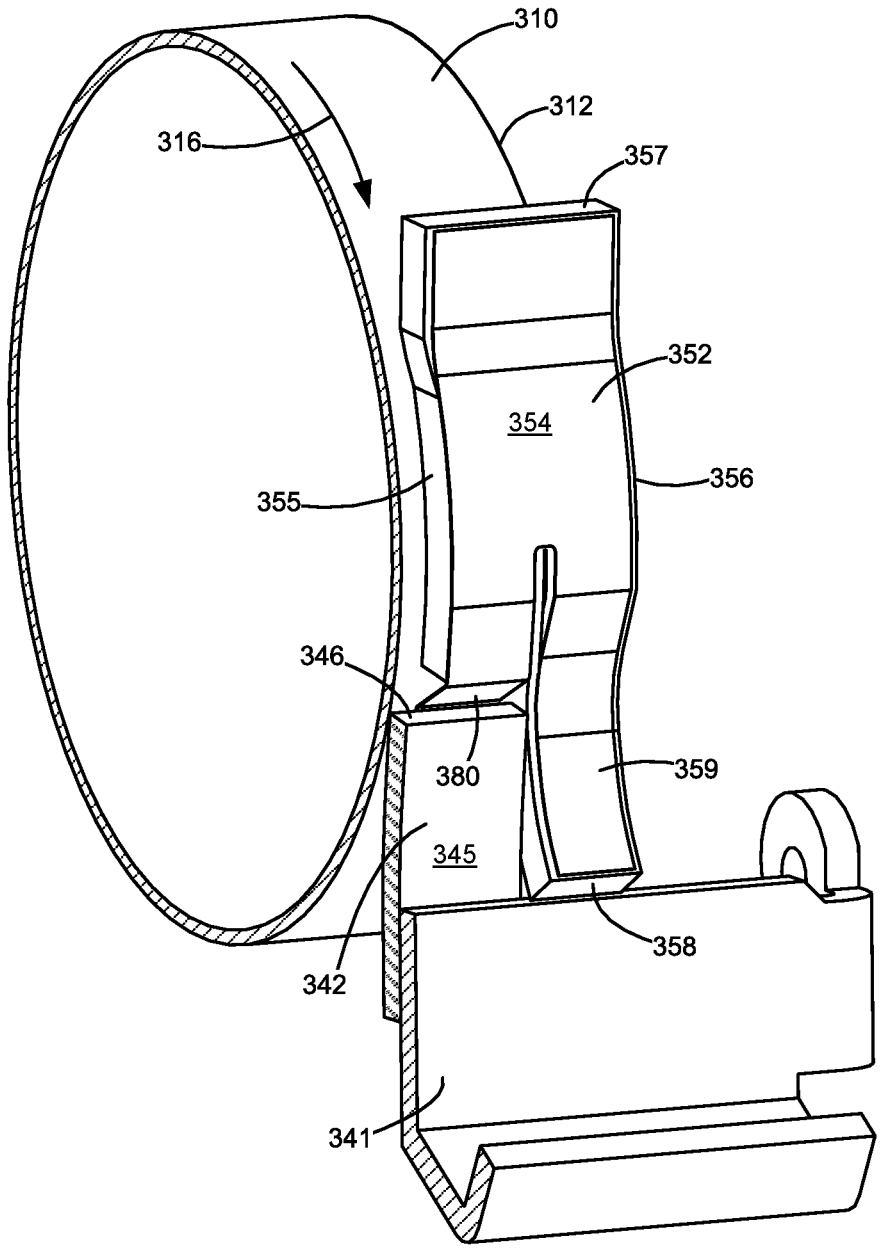
FIG. 13 is a rear perspective view of the cleaner assembly showing the end seal shown in FIGS. 11 and 12 positioned against the photoconductive drum and the low friction tab on the end seal separating a longitudinal end section of the cleaner blade from the surface of the photoconductive drum according to one example embodiment.
Figure 14:
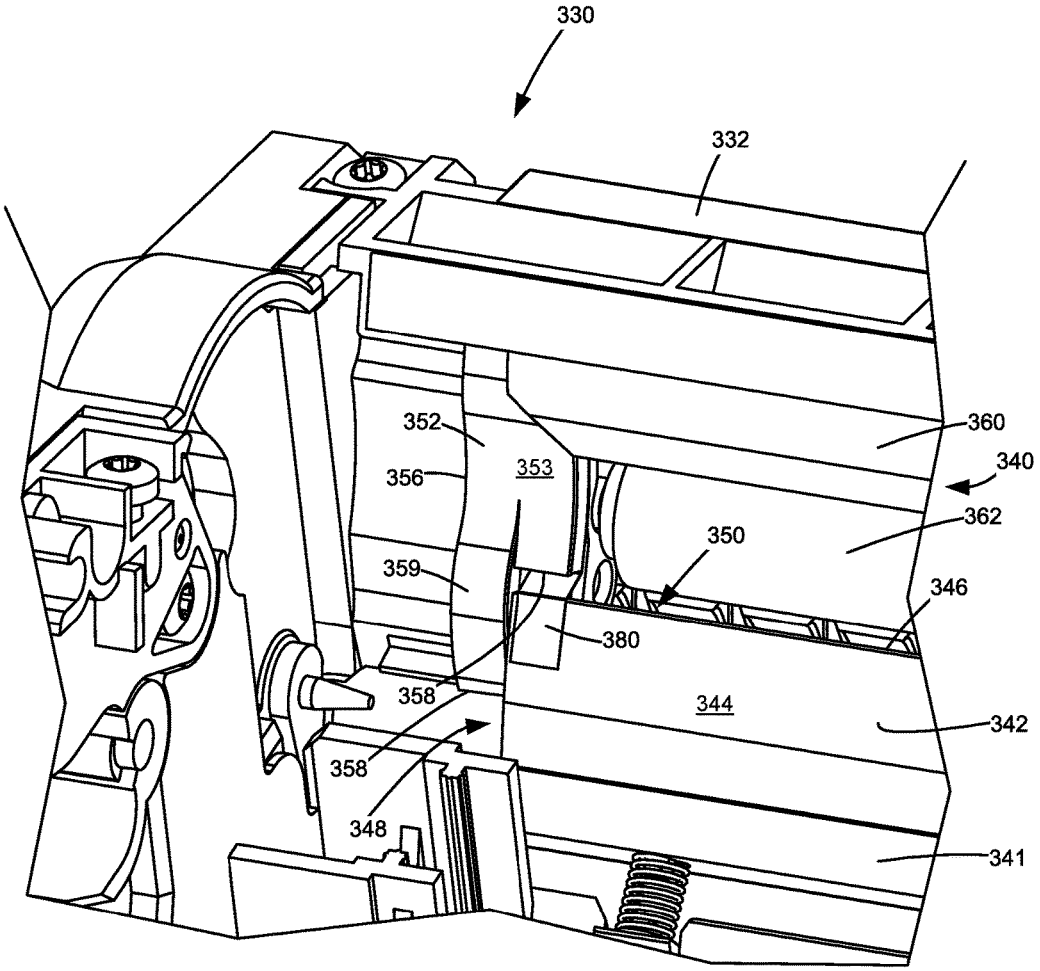
FIG. 14 is a perspective view of a portion of the photoconductor unit with the photoconductive drum and the charge roll omitted showing the cleaner assembly having the end seal shown in FIGS. 11-13 installed relative to the cleaner blade according to one example embodiment.

FIG. 13 shows end seal 352 having tab 380 positioned against PC drum 310 during operation. As discussed above, tab 380 forms a low friction barrier between cleaner blade 342 and PC drum 310 (between front side 344 and cleaning edge 346 of cleaner blade 342 and PC drum 310) at the longitudinal end 348 of cleaner blade 342 in order to reduce the otherwise high frictional force applied to cleaner blade 342 at the longitudinal ends 348 of cleaner blade 342 that can lead to cleaner blade 342 flips. FIG. 14 shows tab 380 positioned at the longitudinal end 348 of cleaner blade 342 with PC drum 310 and charge roll 308 omitted for clarity. As shown in FIG. 14, in the embodiment illustrated, tab 380 does not obstruct front side 353 of end seal 352 upstream from (relative to the operative rotational direction 316 of PC drum 310) cleaning edge 346 of cleaner blade 342 such that tab 380 does not compromise the sealing of PC drum 310 provided by end seal 352. That is, front side 353 of end seal 352 is not blocked by tab 380 from contacting the surface of PC drum 310 upstream from cleaning edge 346 of cleaner blade 340.

While the example discussed above include a cleaner assembly 340 for a photoconductive drum 310, it will be appreciated that cleaner assembly 340 is applicable to other residual and/or waste toner removal systems as well, such as, for example, a cleaner assembly for removing residual toner from ITM 190.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for an electrophotographic image forming device, comprising:

a rotatable photoconductive drum having a rotational axis and a pair of axial ends;

a cleaner blade extending longitudinally along the rotational axis of the photoconductive drum, the cleaner blade has a cleaning edge that contacts a surface of the photoconductive drum to remove toner from the surface of the photoconductive drum;

a first end seal and a second end seal each positioned at a respective axial end of the photoconductive drum, each of the first and second end seals includes a front side and a rear side opposite the front side, at least a portion of the front side of each of the first and second end seals contacts the surface of the photoconductive drum;

a first tab extending between the cleaner blade and the photoconductive drum preventing a first longitudinal end section of the cleaner blade from contacting the surface of the photoconductive drum, the first tab is anchored at the rear side of the first end seal or to an intermediate layer of the first end seal between the front and rear sides of the first end seal, the first tab is composed of a lower friction material than the portion of the front side of the first end seal that contacts the surface of the photoconductive drum; and a second tab extending between the cleaner blade and the photoconductive drum preventing a second longitudinal end section of the cleaner blade from contacting the surface of the photoconductive drum, the second tab is anchored at the rear side of the second end seal or to an intermediate layer of the second end seal between the front and rear sides of the second end seal, the second tab is composed of a lower friction material than the portion of the front side of the second end seal that contacts the surface of the photoconductive drum.

2. The replaceable unit of claim 1, wherein the first and second tabs are attached to the first and second end seals, respectively.

3. The replaceable unit of claim 2, wherein the first and second tabs are adhered to the first and second end seals, respectively.

4. The replaceable unit of claim 2, wherein the first tab is attached to the rear side of the first end seal and the second tab is attached to the rear side of the second end seal.

5. The replaceable unit of claim 2, wherein the first and second tabs are laminated onto the first and second end seals, respectively, forming a unitary piece with the first and second end seals, respectively.

6. The replaceable unit of claim 1, wherein the first and second tabs extend in a cantilevered manner from the first and second end seals, respectively.

7. The replaceable unit of claim 1, wherein the first and second end seals each include a downstream end with respect to an operative rotational direction of the photoconductive drum, wherein the first and second tabs extend from the downstream ends of the first and second end seals and a gap is present between the downstream ends of the first and second end seals from which the first and second tabs extend and the cleaning edge of the cleaner blade.

8. A cleaner assembly for an electrophotographic image forming device, comprising:

a cleaner blade having a pair of longitudinal ends and a cleaning edge that extends between the pair of longitudinal ends for contacting a surface of a photoconductive drum to remove toner from the surface of the photoconductive drum;

an end seal positioned at one of the pair of longitudinal ends of the cleaner blade, the end seal includes a front side positioned to contact the surface of the photoconductive drum and a rear side opposite the front side; and a tab extending from the end seal across the cleaning edge of the cleaner blade for preventing a longitudinal end section of the cleaning edge of the cleaner blade from contacting the surface of the photoconductive drum, wherein the tab does not obstruct the front side of the end seal.

9. The cleaner assembly of claim 8, wherein the tab is attached to the end seal.

10. The cleaner assembly of claim 9, wherein the tab is attached to the rear side of the end seal.

11. The cleaner assembly of claim 9, wherein the tab is adhered to the end seal.

12. The cleaner assembly of claim 9, wherein the tab is laminated onto the end seal forming a unitary piece with the end seal.

13. The cleaner assembly of claim 8, wherein the tab extends in a cantilevered manner from the end seal.

14. The cleaner assembly of claim 8, wherein the tab extends from a bottom end of the end seal and a gap is present between the bottom end of the end seal from which the tab extends and the cleaning edge of the cleaner blade.

15. An end seal for sealing an end portion of a photoconductive drum in an electrophotographic image forming device, comprising:

a body having a front side contoured to contact a surface of the photoconductive drum and a rear side opposite the front side; and a tab attached to at least one of the rear side of the body and an intermediate layer of the body between the front and rear sides of the body, the tab extends from the body and is positioned to fit between the photoconductive drum and a cleaner blade to prevent a portion of the cleaner blade from contacting the surface of the photoconductive drum, the tab is composed of a lower friction material than the front side of the body.

16. The end seal of claim 15, wherein the tab is attached to the rear side of the body.

17. The end seal of claim 15, wherein the tab is adhered to the body.

18. The end seal of claim 15, wherein the tab is laminated onto the body forming a unitary piece with the body.

19. The end seal of claim 15, wherein the tab extends in a cantilevered manner from the body.

20. The end seal of claim 15, wherein the tab extends from a bottom end of the body at a first side of the body and the body includes a leg at a second side of the body that is opposite the first side of the body, the leg extends past the bottom end of the body at the first side of the body from which the tab extends.

* * * * *